US011022306B2

(12) United States Patent
Romero et al.

(10) Patent No.: US 11,022,306 B2
(45) Date of Patent: Jun. 1, 2021

(54) FIDGET LIGHTER DEVICE

(71) Applicants: Jonathan Romero, Boston, MA (US); Leandro Molina, Somerville, MA (US)

(72) Inventors: Jonathan Romero, Boston, MA (US); Leandro Molina, Somerville, MA (US)

( * ) Notice: Subject to any disclaimer, the term of this patent is extended or adjusted under 35 U.S.C. 154(b) by 0 days.

(21) Appl. No.: 16/168,736

(22) Filed: Oct. 23, 2018

(65) Prior Publication Data

US 2019/0120488 A1 Apr. 25, 2019

Related U.S. Application Data

(60) Provisional application No. 62/707,119, filed on Oct. 23, 2017.

(51) Int. Cl.

| | |
|---|---|
| ***F23Q 2/32*** | (2006.01) |
| ***A63H 33/00*** | (2006.01) |
| ***A63H 1/00*** | (2019.01) |
| ***F23Q 2/36*** | (2006.01) |
| ***F23Q 2/167*** | (2006.01) |
| ***F23Q 2/16*** | (2006.01) |

(52) U.S. Cl.

CPC ..... *F23Q 2/32* (2013.01); *A63H 1/00* (2013.01); *A63H 33/002* (2013.01); *F23Q 2/161* (2013.01); *F23Q 2/167* (2013.01); *F23Q 2/36* (2013.01)

(58) Field of Classification Search

CPC ..... F23Q 2/32; A63H 1/00; A63H 33/003
USPC ..... 431/142, 153
See application file for complete search history.

(56) References Cited

U.S. PATENT DOCUMENTS

| | | | | |
|---|---|---|---|---|
| 3,816,056 | A * | 6/1974 | Brown | G04B 47/006 431/253 |
| 5,591,062 | A * | 1/1997 | Hettinger | A63B 67/086 446/240 |
| 6,390,809 | B1 * | 5/2002 | Gerace | F23Q 2/164 431/153 |
| 10,016,693 | B1 * | 7/2018 | Dowdy | A63H 33/003 |
| D872,807 | S * | 1/2020 | Lowsky | D21/455 |
| 2002/0076667 | A1 * | 6/2002 | Man | F23Q 2/164 431/142 |
| 2009/0227174 | A1 | 9/2009 | d'Entremont | |
| 2018/0332155 | A1 * | 11/2018 | Babbage | H04M 1/21 |
| 2018/0342930 | A1 * | 11/2018 | Roberts | A63H 33/26 |
| 2018/0352829 | A1 * | 12/2018 | Diamond | A63H 29/08 |
| 2018/0353868 | A1 * | 12/2018 | Albert | A63H 1/10 |

FOREIGN PATENT DOCUMENTS

KR 200483621 Y1 6/2017

* cited by examiner

*Primary Examiner* — Albert K Wong

(57) ABSTRACT

A device including a device body for storing fuel; a spark wheel that may be used as a first fidget device is configured to rotate against a flint to produce igniting sparks; a flame setting indicator for indicating low flame (LO), high flame (HI), and flame off (OFF); a tab portion for pointing to at least one of the flame setting settings; a flame-height adjuster for decreasing or increasing a flame ignited by said sparks, or turning off a supply of fuel; a rotating disc implement that may be used as a second fidget device, wherein the rotating disc implement is configured to significantly flush-mount against the device body and to customarily rotate freely against the device body; a circular indentation implement disposed on a proximate center portion of said lighter body section is configured to generally secure said rotating disc implement.

12 Claims, 9 Drawing Sheets

FIDGET LIGHTER DEVICE

CROSS-REFERENCE TO RELATED APPLICATIONS

The present Utility patent application claims priority benefit of the U.S. provisional application for patent Ser. No. 62/707,119, entitled "FLKR", and filed on Oct. 23, 2017 under 35 U.S.C. 119(e). The contents of this related provisional application are incorporated herein by reference for all purposes to the extent that such subject matter is not inconsistent herewith or limiting hereof.

RELATED U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to lighting devices and fidget devices. More particularly, certain embodiments of the invention relate to a fidget lighter device.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. While the number of regular cigarette smokers has begun to decline, the size of this consumer market is still quite large. Over 30 million adult Americans smoke tobacco every day. The market for cigarette lighters is huge, too. These millions of regular smokers purchase lighters at an average rate of one a month, resulting in annual sales of 370 million units in the U.S. for over half a billion dollars. Butane lighters are normally manufactured and sold as pocket-sized, relatively inexpensive items. A reduction in the structural complexity and manufacturing costs of lighters may have provided a significant economic advantage enhancing the commercial success thereof. In addition, reduced complexity may have improved the operating characteristics and performance reliability of such lighters.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that fidget toys provide quick and easy amusement that may typically be used for therapy and relieve tension. Many people like to keep their hands busy by playing with coins, pens, lighters, knives, fidget toys, or the like. Flipping and spinning things around in one's hand may, in essence be a calming activity, and many people use these types of devices as cessation devices or to relieve stress and/or anxiety. Some people, by and large, may enjoy using flipping and/or spinning devices solely for fun.

Lighters in which butane or other gaseous fluid is employed, for the most part, have proven to be popular with smokers for the reason that this type of fuel lends itself to storage for considerably long periods as a liquid under pressure and may readily vaporize when released to the atmosphere, commonly producing a smokeless flame through a valve which may be appreciably adjusted to govern the height of the flame in relation to the flame tip of the lighter. Often, smokers may habitually suffer from fidgeting tendencies and may markedly need that hand stimulation of holding something, like a cigarette. In the absence of a cigarette, smokers may absent-mindedly hold their lighter and customarily strike them for no apparent reason. For the most part, it may be a fidget tendency that helps to fundamentally relieve a bit of anxiety and/or stress. However, repeatedly striking a lighter may cause the lighter to considerably run out of fuel faster than it should. A product, on the whole, may be needed that normally serves as a lighter and at the same time, as a cessation device to relieve stress and/or anxiety.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
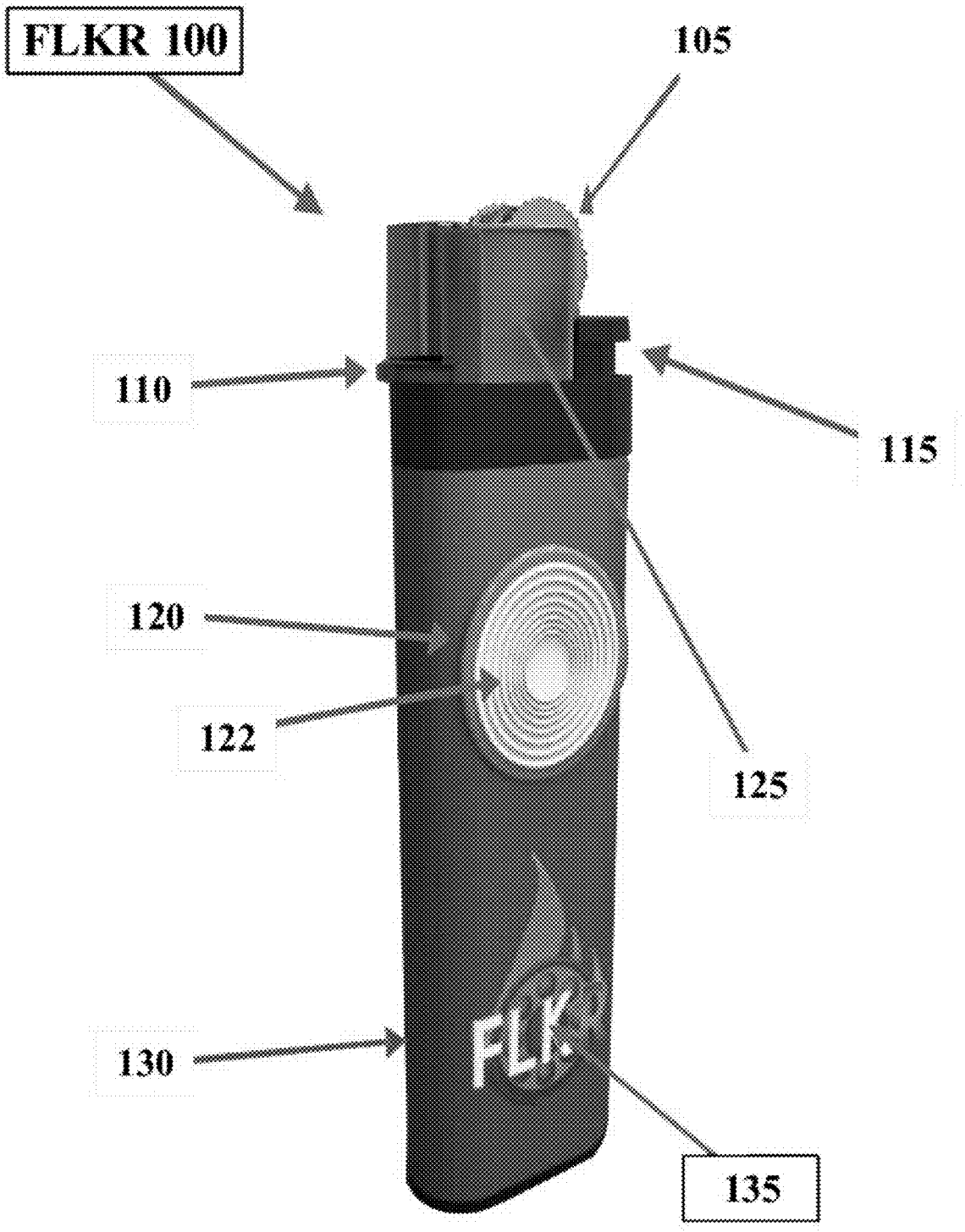
FIG. 1 is an illustration of an exemplary lighter with fidget device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settled law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognize in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" include the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising" And "contain" and variations of them—Such terms are open-ended and mean "including but not limited to". When employed in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

All terms of exemplary language (e.g., including, without limitation, "such as", "like", "for example", "for instance", "similar to", etc.) are not exclusive of any other, potentially, unrelated, types of examples; thus, implicitly mean "by way of example, and not limitation . . . ", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Moreover, any claim limitation phrased in functional limitation terms covered by 35 USC § 112(6) (post AIA 112(f)) which has a preamble invoking the closed terms "consisting of," or "consisting essentially of," should be understood to mean that the corresponding structure(s) disclosed herein define the exact metes and bounds of what the so claimed invention embodiment(s) consists of, or consisting essentially of, to the exclusion of any other elements which do not materially affect the intended purpose of the so claimed embodiment(s).

Devices or system modules that are in at least general communication with each other need not be in continuous communication with each other, unless expressly specified otherwise. In addition, devices or system modules that are in at least general communication with each other may communicate directly or indirectly through one or more intermediaries. Moreover, it is understood that any system components described or named in any embodiment or claimed herein may be grouped or sub-grouped (and accordingly implicitly renamed) in any combination or sub-combination as those skilled in the art can imagine as suitable for the particular application, and still be within the scope and spirit of the claimed embodiments of the present invention. For an example of what this means, if the invention was a controller of a motor and a valve and the embodiments and claims articulated those components as being separately grouped and connected, applying the foregoing would mean that such an invention and claims would also implicitly cover the valve being grouped inside the motor and the controller being a remote controller with no direct physical connection to the motor or internalized valve, as such the claimed invention is contemplated to cover all ways of grouping and/or adding of intermediate components or systems that still substantially achieve the intended result of the invention.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Some embodiments of the present invention and variations thereof, relate to lighting devices and fidget devices. In one embodiment of the present invention, the lighting device, to all intents and purposes, doubles as a fidget device. The fidget device, for the most part, is built into the cigarette lighter. The cigarette lighter includes a dip tube that accesses fuel such as, but not limited to, butane from within its hollow body. A valve mainly releases the fuel with a spring-operated lever, and fuel volume is significantly controlled by a flame height adjuster. The valve is configured to generally prevent unwanted access to the butane fuel of the lighter. A striker/spark wheel usually contacts a flint, which creates the spark needed to ignite the fuel. A shroud, by and large, encases the top portions of the valve and flint. A flame height adjustor, in essence, allows the flow of fuel to be turned off when desired. This may allow the striker/spark wheel to be repetitively used without unintentional, unwanted release of fuel from the lighter. By significantly controlling access to its fuel, the fidget lighter device allows users to engage in common fidget activity of ordinarily repetitive spark wheel rotation without risk of fuel waste.

In other embodiments, each side of the lighter includes a fidget device with free-rotating disc, allowing the lighter to spin with ease. The free-rotating discs of the device are generally flush to the lighter body which may provide a second fidget device, the striker/spark wheel being the other fidget device. Since the free-rotating discs of the device are flush to the lighter body, the discs may be free from getting caught upon or getting snagged with other objects in its place of storage, such as but not limited to the material of a pants pocket and/or the lining of a purse. By not being subject to snagging upon such objects as pants pockets and purse linings, the fidget lighter device may not impose risk of damage to such objects. By not being subject to snagging, the fidget lighter device may significantly reduce risk of damage to or blockage of its rotating discs, which would prevent the device from working as intended.

In some embodiments, the lighter typically measures approximately three and one-quarter inches in height by one inch in width by one-half inch in depth (3¼"×1"×½"). The lighter may comprise a hollow body that contains mainly butane fuel, a dip tube that basically accesses the fuel, a nozzle or burner disposed at an end portion of the dip tube, a valve that fundamentally releases the fuel, a lever with spring that largely opens the valve, a flame height adjuster that considerably controls the amount of fuel flowing through the valve, a striker wheel, a flint below said striker wheel, and a shroud that predominantly encases the top portions of the valve, burner and flint. Strategically-positioned on each proximate side wall of the hollow body is a free-rotating disc of, but not limited to, an approximate three-quarter inch (¾") diameter. The free-rotating discs comprise of ball-bearing rings, each with cap covering made of but not limited to, plastic, metal, wood, polymer material, synthetic material, etc. The depth of the ball-bearing rings largely ensures the top surface of the cap covering is to a great extent flush with the remaining body of the hosting lighter. A flame height adjuster includes a solid plate which predominantly seals the gas outlet valve of the lighter when the flame-height adjuster is in the OFF position. With the lighter, a user may significantly achieve entertainment, relief from boredom, distraction, and/or stress relief that may or may not be related to nicotine deficiency. In use, the user may position the flame height adjuster of the lighter so that it appreciably blocks the gas outlet valve, and the user may then repetitively spin the striker wheel.

In other embodiments, the new and improved fidget device and lighter combination generally function as a fidget spinner and a butane lighter. The fidget lighter device is significantly balanced to allow easy and even spinning. Further, the fidget device and lighter combination may provide two fidget features. The spinner design may provide the first fidget feature and the ability to rapidly rotate the spark wheel without wasting butane may provide the second fidget feature. The body of the lighter features two circular indentations, one on each side. A ball bearing ring system is considerably securely fastened within each of the two circular indentations. A featured covering cap may provide cover and/or protection for each ball bearing system. The exterior surface of each cap is slightly texturized to provide a substantial grip enhancement for the user. The ball bearing ring system and cap design is substantially flush to the body of the lighter as not to pose a significant snag risk during pocket/purse storage. The fidget lighter device may allow the user to temporarily disable the flow of butane. This may be accomplished by mainly incorporating an Off Position into an existing flame-height adjuster or by incorporating a new lever or switch. In the Off Position option, a plate implement may be positioned over the flow of butane fuel through the nozzle to essentially stop the flow of the butane fuel. Other means may be used as well. As the butane fuel may be temporarily disabled, the user may customarily strike the lighter as often as desired without lighting the lighter and significantly wasting butane fuel.

The present invention will now be described in detail with reference to embodiments thereof as illustrated in the accompanying drawings.

FIG. 1 is an illustration of an exemplary lighter with a fidget device (FLKR) 100, in accordance with an embodiment of the present invention. In the present embodiment shown, the fidget lighter device 100 comprises a flame-height adjuster 110, a fuel release lever 115, a fidget device 120 having a free-rotating disc 122 and a spark wheel 105, a shroud implement 125, a lighter body section 130, and an image area 135 for generally displaying icons, brand names, product names, advertisements, instructions, etc. The lighter body section 130 is configured to store fuel such as butane or other compressible liquid fuels. The lighter body section 130 may be comprised of various shapes such as, but not limited to, oblong, cylindrical, rectangular, square, circular, triangular, hexagonal, pentagonal, etc. and may be made of, but not limited to, plastic, metal, polymeric materials, tempered glass, etc. The spark wheel 105 may be rotated against a flint which may produce igniting sparks. The shroud implement 125 is configured to cover and/or protect a fuel discharge nozzle, the flame-height adjuster 110, and the spark wheel 105. The flame-height adjuster 110 may comprise of a flow rate lever for controlling the flow of fuel to the discharge nozzle. The ignited sparks interact with fuel discharged by the nozzle to produce a flame. The shroud implement 125 may comprise of markings for normally indicating flame settings. The flame-height adjuster 110 adjusts an amount of fuel being discharged through the nozzle based on the flame setting indicator. In one embodiment, the spark wheel 105 may be rotated repeatedly. For example, when used as a striker or first fidget device. The flame-height adjuster 110 may be set to an Off position to restrict the flow of fuel. So that when the spark wheel 105 rotates against the flint which may produce igniting sparks, no flame may be produced since no fuel is released.

In another embodiment, there is a free-rotating disc 122 disposed on both sides of the lighter body section 130 which may be used as a second or spinner fidget device, the spark wheel 105 being the first or striker fidget device or vice versa. The free-rotating discs 122 are, by and large, appreciably flush-mounted on the lighter body section 130. Since the free-rotating discs 122 of the device are appreciably flush against the lighter body, the discs 122 may be free from getting caught upon or getting snagged with other objects in its place of storage, such as but not limited to the material of a pants pocket and/or the lining of a purse. By not being subject to habitual snagging upon such objects as pants pockets and purse linings, the fidget lighter device 100 may not impose considerable risk of damage to such objects. By not being subject to habitual snagging, the fidget lighter device 100 may significantly reduce the risk of damage to or blockage of its rotating discs 122, which may prevent the device from working as intended.

Figure 2:
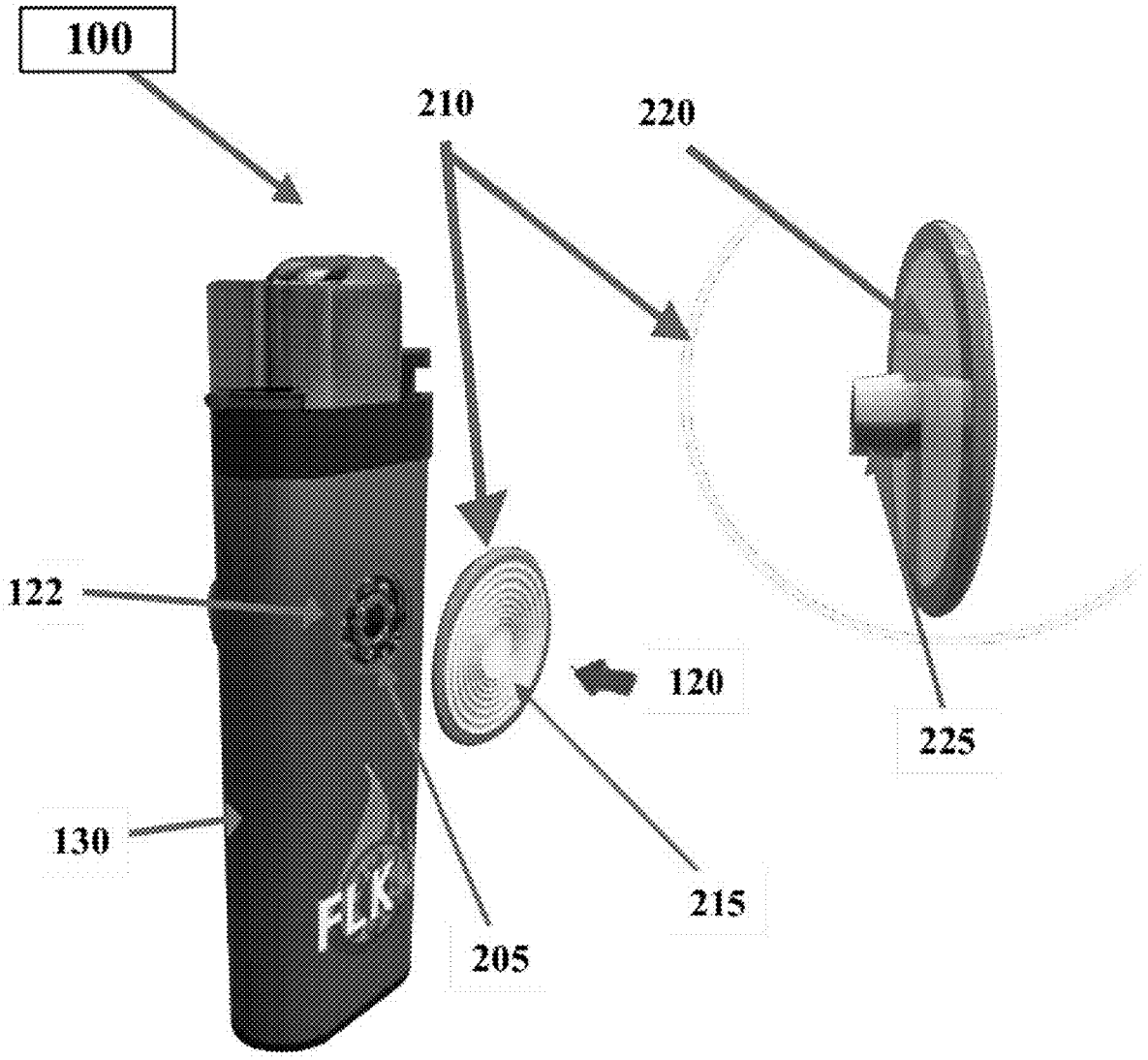
FIG. 2 is an exemplary fidget device, in accordance with an embodiment of the present invention.

FIG. 2 is an illustration of an exemplary fidget device 120, in accordance with an embodiment of the present invention. In the present embodiment shown, the free-rotating disc 122 comprises a ball-bearing assembly 205 and a ball-bearing cap implement 210 disposed on a proximate center segment of the lighter body 130. The ball-bearing cap implement 210 includes a nodule piece 225. The ball-bearing cap implement 210 is configured to mainly provide cover and protection for the ball-bearing assembly 205. The nodule piece 225 fits within a proximate center hole of the ball-bearing assembly 205 and considerably holds the cap implement 210 in place. The ball-bearing assembly 205 basically enables the discs 122 to rotate freely. The free-rotating disc 122, for the most part, enables the lighter to rotate freely when held between two fingers of a user. An outer portion 215 of the ball-bearing cap implement 210 as shown may, by and large, textured and may be predominantly made of, but not limited to, plastic, metal, polymer material, glass, wood, etc. The texture may include but not limited to, circular waves, raised dots, grooves and ridges, etc. An inner portion 220 of the ball-bearing cap implement 210 is mostly smooth so as not to significantly introduce friction between the ball-bearing and cap implement. The inner portion 220 of the ball-bearing cap implement 210 may be made of, but not limited to, plastic, metal, polymer material, glass, wood, etc.

Figure 3:
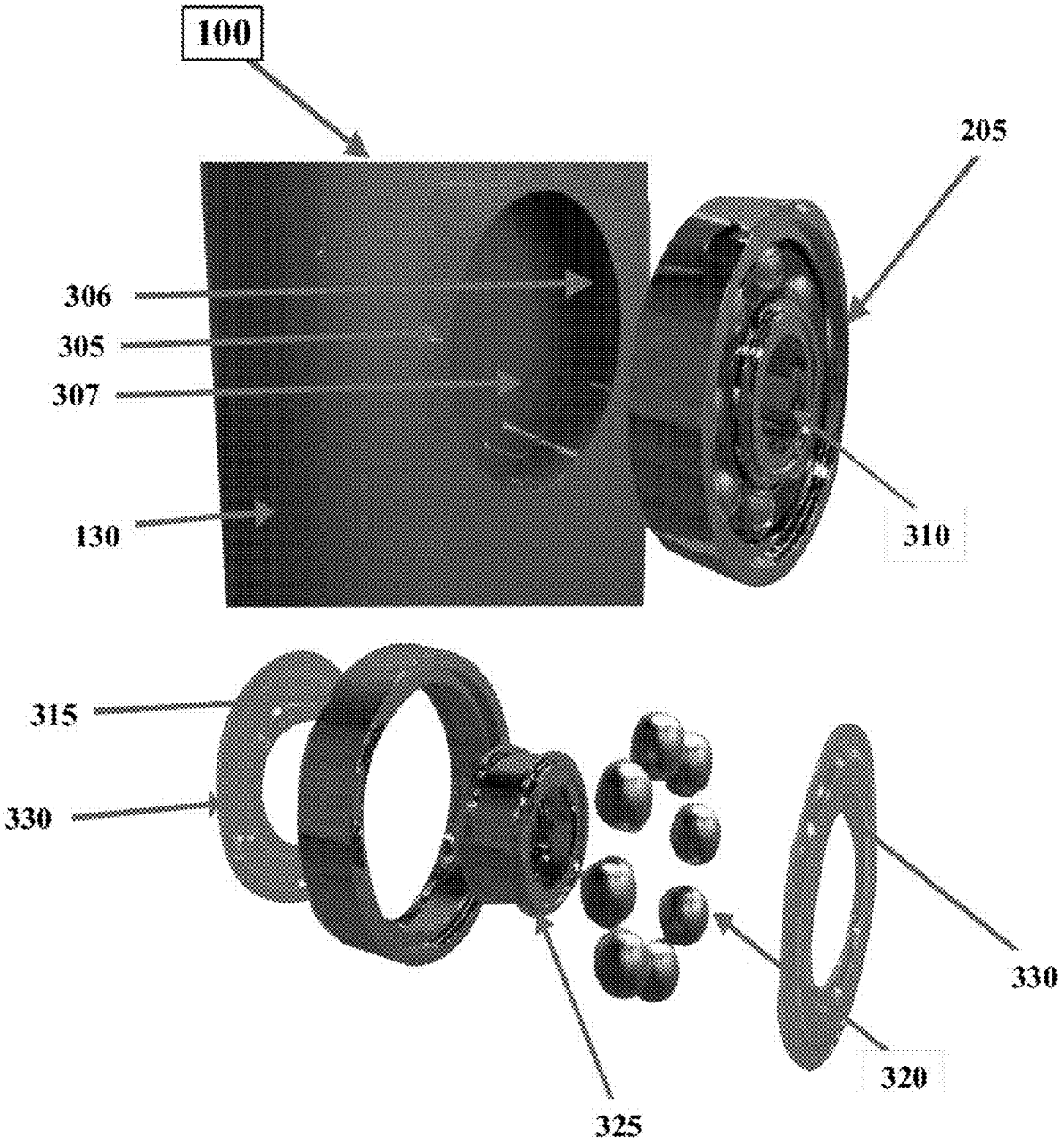
FIG. 3 is an illustration of an exemplary ball bearing assembly, in accordance with an embodiment of the present invention.

FIG. 3 is an illustration of an exemplary ball-bearing assembly 205 disposed in a lighter body 130, in accordance with an embodiment of the present invention. In the present embodiment, a circular indentation 305 disposed within a first side the body of the lighter 130 and an illustration of the ball-bearing assembly 205 is shown. The circular indentation 305 comprises a wall 306 and a sealed base 307. The circular indentation 305 is configured to receive the ball-bearing assembly 205 and cap implement 210, where the ball-bearing assembly 205 and cap implement 210 are appreciably flush mounted against the lighter body 130. The ball bearing assembly 205 comprises a proximate center hole 310, an outer ring portion 315, a plurality of ball bearings 320, and an inner ring portion 325. The proximate center hole 310 is operable for receiving the nodule piece 225 of the cap implement 210, where the cap implement 210 is appreciably flush against the lighter body 130. In other embodiments, the lighter body 130 comprises two circular indentations 305 for securing two ball-bearing assemblies 205 and two cap implements 210. The ball-bearing assemblies 205 may be held in place by various means, such as but not limited to, tension, adhesives, tongue and groove, spring-loaded tabs, tab and slot assemblies, etc. Each of the two circular indentations 305 being disposed on each side of the lighter body 130. And, each of the two circular indentations 305 being configured to secure a ball-bearing assembly 205 and a cap implement 210 on each side of the lighter body 130. In additional embodiments, the wall of the circular indentation goes through the first side of the lighter body and into the second side without blocking the flow of fuel and strengthen the foundation of the rotating.

Figure 4:
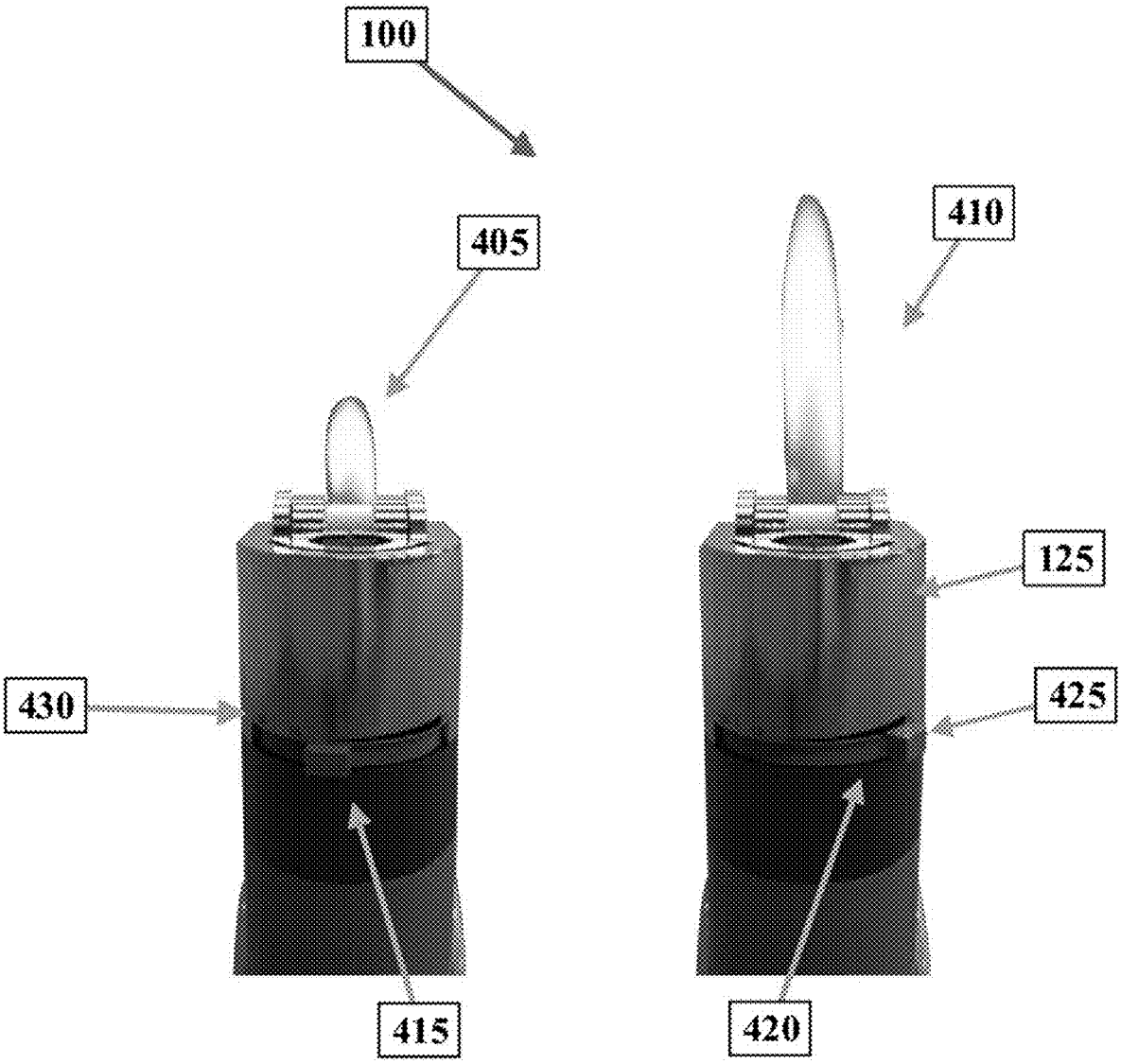
FIG. 4 is an exemplary fidget lighter device illustrating a flame-height adjuster, in accordance with an embodiment of the present invention.

FIG. 4 is an illustration of an exemplary fidget lighter device showing the flame-height adjuster 110 positioning, in accordance with an embodiment of the present invention. In the present embodiment shown, the flame-height adjuster 110 comprises a tab portion 425 for positioning said flame-height adjuster 110 to a desired flame condition. The tab portion 425 may be used to point to one of at least three (3) flame setting indicators 430 including a low flame position (LO) 415, a high flame position (HI) 420 and a flame off setting (OFF) (see 505, FIG. 5). When the flame-height adjuster 110 is in a low position 415, the lighter provides a short flame 405. When the flame-height adjuster 110 is in a high position 420, the lighter provides a tall flame 410. When the tab portion 425 points to the flame off setting (OFF), access to fuel is turned off and therefore even if the spark wheel 105 is rotated against the flint to ignite a spark, there may be no flame produced.

Figure 5:
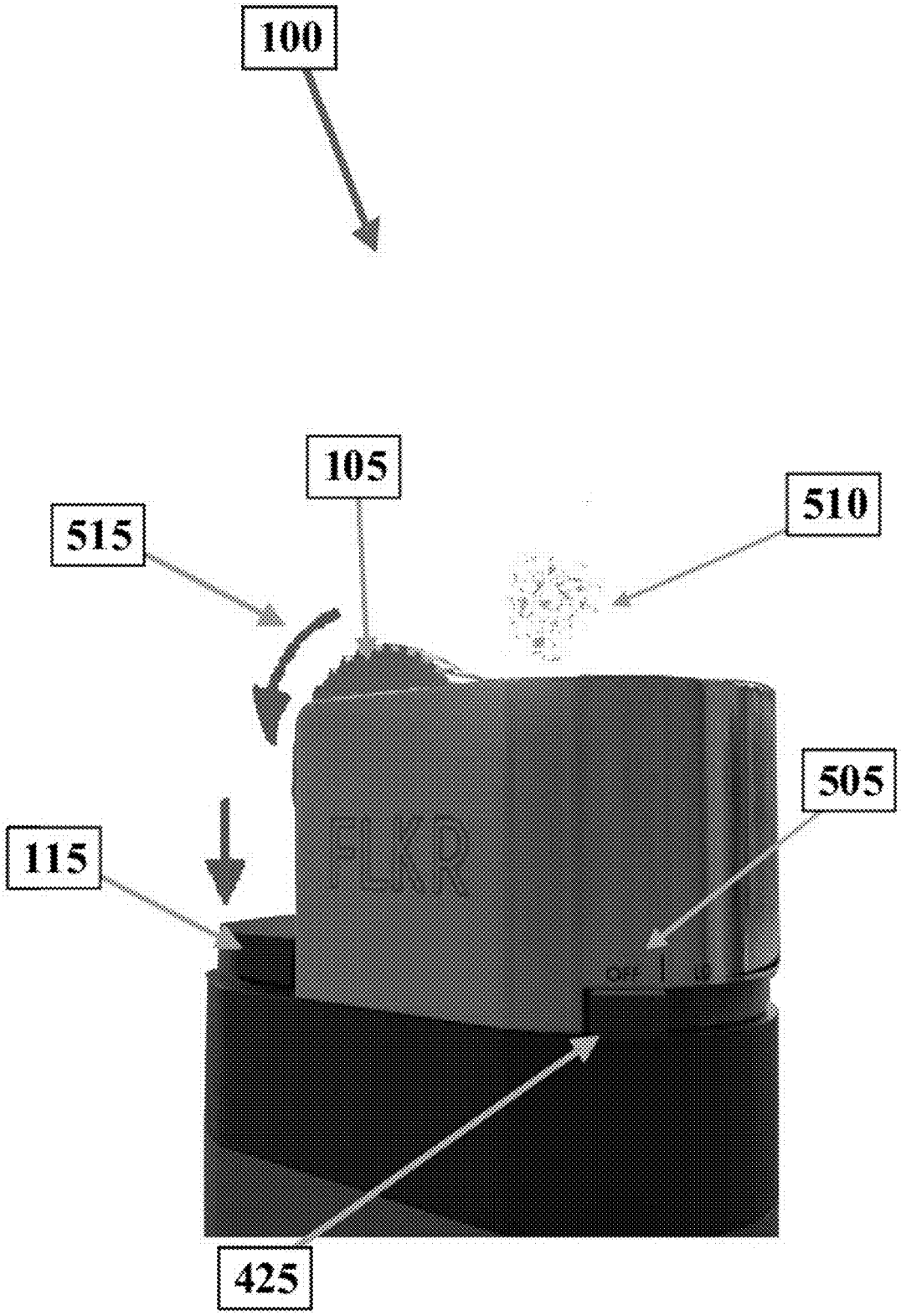
FIG. 5 is an illustration of an exemplary use of a spark wheel as a fidget mechanism, in accordance with an embodiment of the present invention.

FIG. 5 is an illustration of an exemplary use of the spark wheel 105 as a fidget device, in accordance with an embodiment of the present invention. In the present embodiment shown, to use the spark wheel 105 as a fidget mechanism, fuel may be turned off by positioning the tab portion 425 of the flame-height adjuster 110 in the flame off setting (OFF) 505 (as a first step). As a result, the spark wheel 105 may now be used as a fidget mechanism where the spark wheel 105 may now be rotated in the direction of the arrow 515 towards the fuel release lever 115 (as a second step). And, the fuel release lever 115 may be customarily pushed with each rotation of the spark wheel 105 without fuel loss (as a third or succeeding step). In this manner, the spark wheel may be rotated repeatedly and/or habitually against a flint which may produce igniting sparks 510 but no flame is produced because no fuel is being released. For example, as a fidget mechanism.

Figure 6:
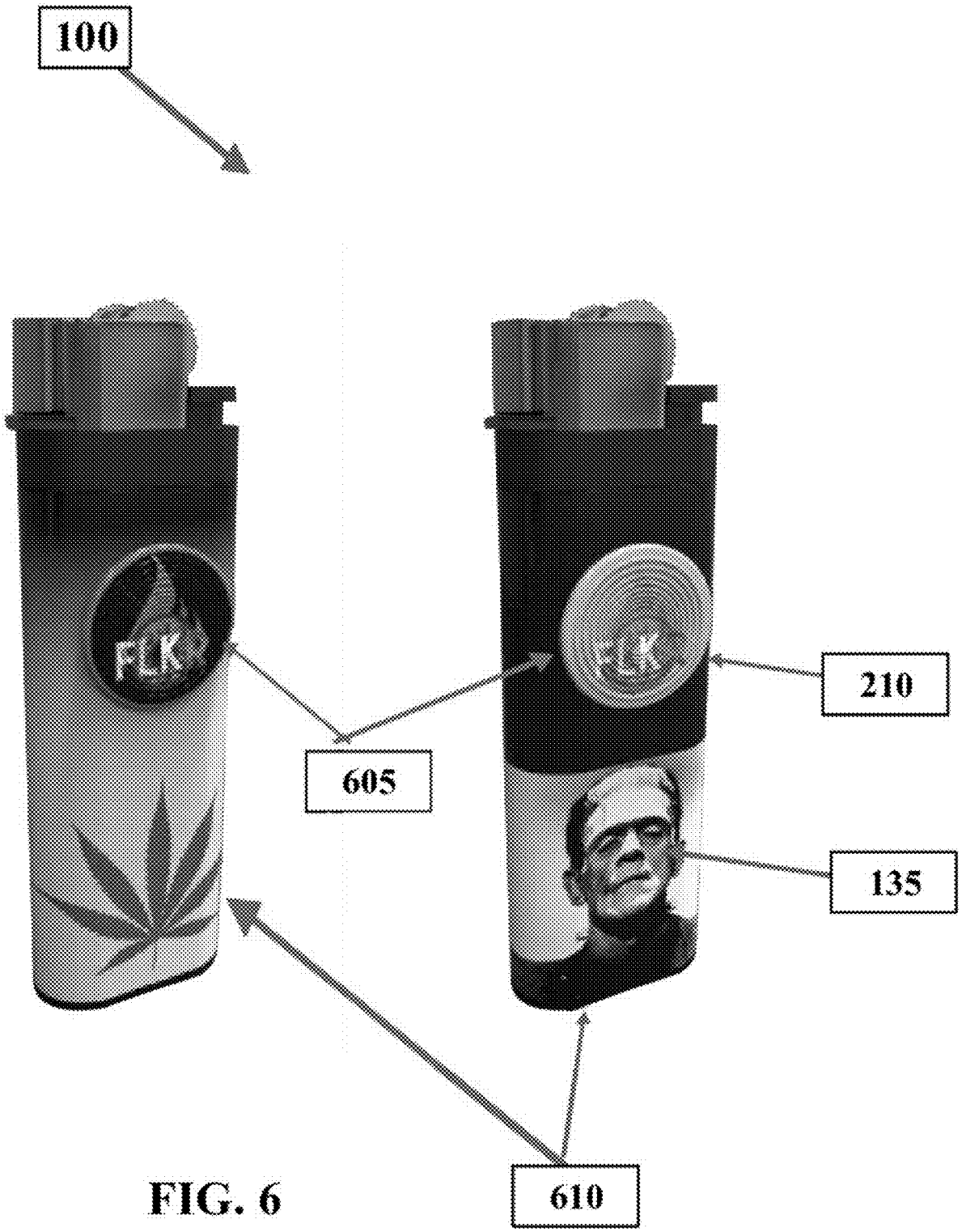
FIG. 6 is an exemplary image display device illustrating a body of the lighter with images, in accordance with an embodiment of the present invention.

FIG. 6 is an exemplary image display device illustrating a body of the lighter with images, in accordance with an embodiment of the present invention. In the present embodiment shown, the image area 135 displays a photo of a leaf and a photo of a person 610. Further, the outer portion 215 of the ball-bearing cap implement 210 may be made to display a brand name 605 or other illustrations, text, images, etc. All images on the lighter body may be applied by a multiplicity of suitable means including, without limitation, digital printing, screen printing, shrink wrap, paint, engravings, etc.

Figure 7:
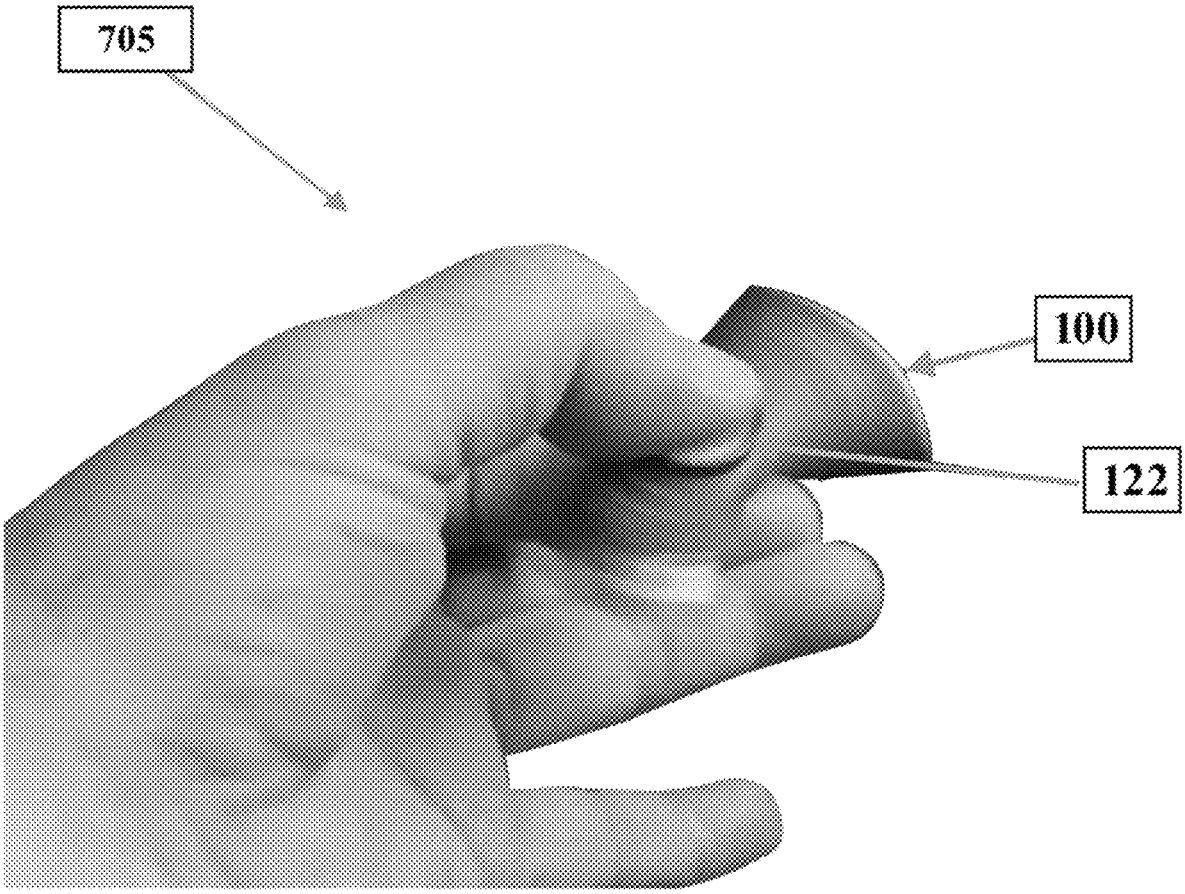
FIG. 7 is an illustration of the exemplary free-rotating disc used as a fidget device, in accordance with an embodiment of the present invention.
Figure 8:
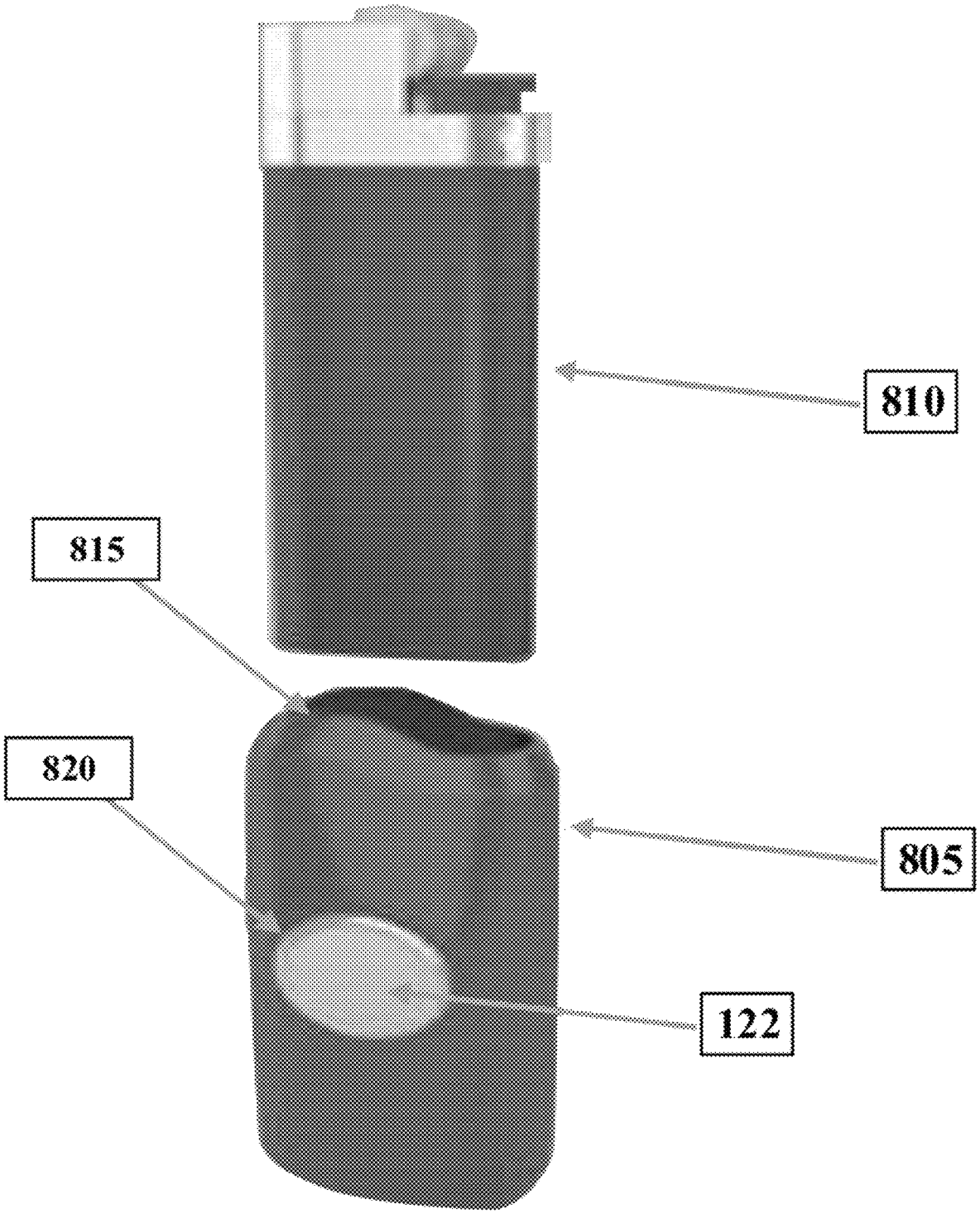
Figure 9:
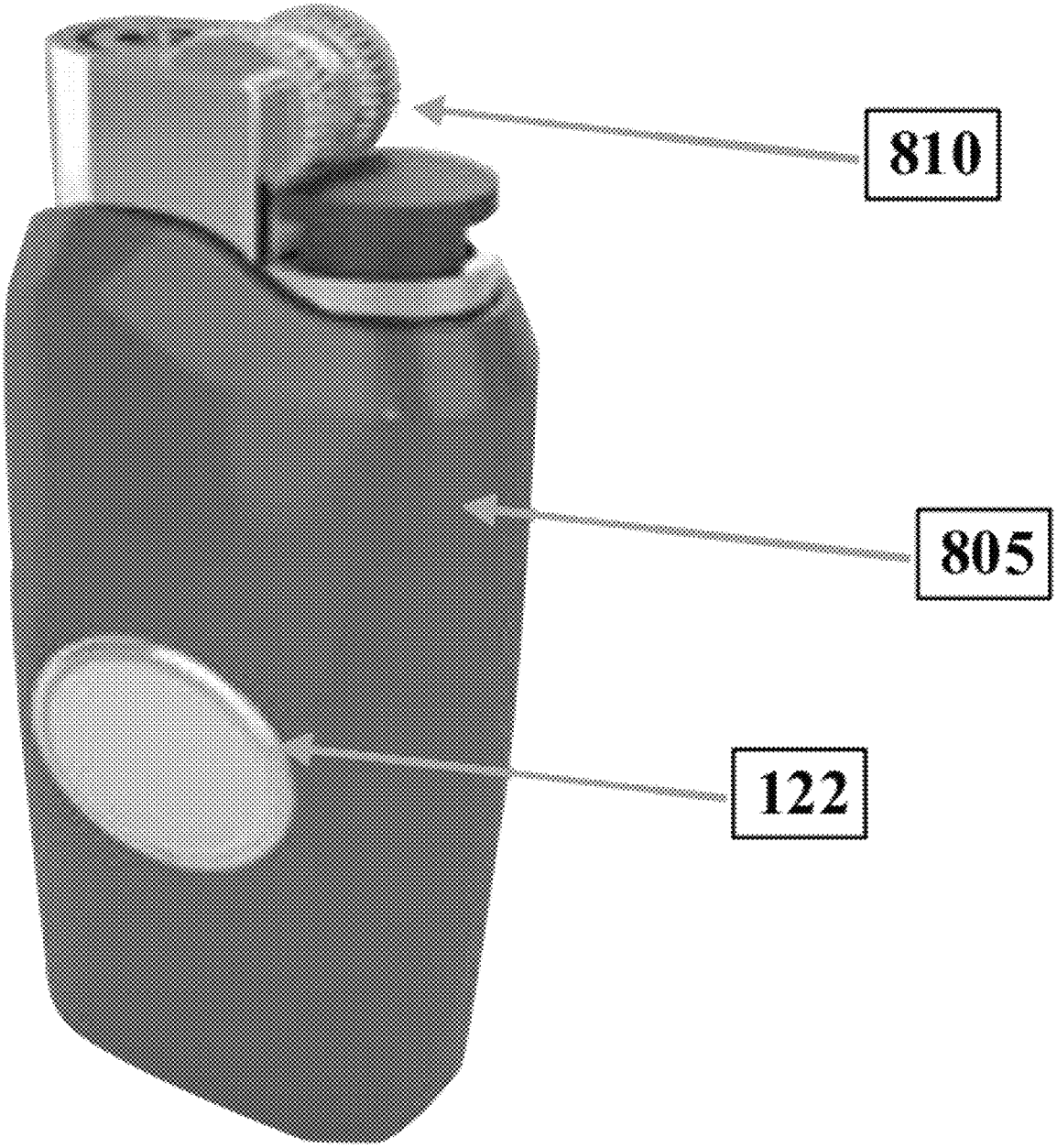

FIG. 7 is an illustration of the exemplary free-rotating disc 122 used as a fidget device, in accordance with an embodiment of the present invention. In the present embodiment shown, the free-rotating disc 122 may be ordinarily held in the fingers 705 of a user while allowing the lighter 100 to normally rotate around the discs 122.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" or "steps for" claim limitation implies that the broadest initial search on 35 USC § 112(6) (post AIA 112(f)) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112(6) (post AIA 112(f)) when such corresponding structures are not explicitly disclosed in the foregoing patent specification. Therefore, for any invention element(s)/structure(s) corresponding to functional claim limitation(s), in the below claims interpreted under 35 USC § 112(6) (post AIA 112(f)), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112(6) (post AIA 112(f)) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112(6) (post AIA 112(f)), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing lighters to double as fidget devices according to the present invention will be apparent to those skilled in the art. Various aspects of the invention have been described above by way of illustration, and the specific embodiments disclosed are not intended to limit the invention to the particular forms disclosed. The particular implementation of the fidget lighter device may vary depending upon the particular context or application. By way of example, and not limitation, the fidget lighter device described in the foregoing were principally directed to butane cigarette lighter implementations; however, similar techniques may instead be applied to other types of lighters, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device, comprising:

a lighter including:

a body to store fuel and having an indentation on at least one side of the body substantially at the center of the body;

a valve coupled to the body to dispense the fuel;

a spark wheel coupled to the body, rotatable against a flint to produce sparks to ignite the dispensed fuel;

a tab coupled to the valve to change the rate of fuel dispensed by the valve; and a rotating element including a first and a second portion rotatably coupled together wherein the first portion is attached to the body inside the indentation.

2. The device of claim 1, wherein the tab turns the valve off.

3. The device of claim 1, wherein the rotating element is mounted flush with the case.

4. The device of claim 1, further comprising a ball bearing assembly within the rotating element.

5. The device of claim 4, further comprising a ball-bearing cap implement to cover and protect the ball bearing assembly.

6. The device of claim 1, wherein the case has a second indentation on the opposite side of the body.

7. The device of claim 6, further comprising a second rotating element mounted in the second indentation.

8. The device of claim 7, wherein the second rotating element is flush mounted with the case.

9. The device of claim 1, further comprising a shroud to surround the sparks and the dispensed fuel.

10. The device of claim 9, wherein the shroud includes markings to indicate flame settings.

11. The device of claim 1, further comprising an image disposed on the body.

12. The device of claim 7, further comprising a second ball bearing in the second rotating element.

* * * * *